US011465064B2

(12) United States Patent
Greenley et al.

(10) Patent No.: US 11,465,064 B2
(45) **Date of Patent: *Oct. 11, 2022**

(54) ARTICULATING OBJECT

(71) Applicants: Spin Master Ltd., Toronto (CA); G2 INVENTIONS LLC, Lake Geneva, WI (US)

(72) Inventors: Peter L. Greenley, Lake Geneva, WI (US); Arta Alagheband, Toronto (CA)

(73) Assignees: Spin Master Ltd., Toronto (CA); G2 INVENTIONS HOLDING, LLC, Lake Geneva, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/915,903

(22) Filed: Jun. 29, 2020

(65) Prior Publication Data

US 2021/0001239 A1 Jan. 7, 2021

Related U.S. Application Data

(63) Continuation of application No. 16/459,591, filed on Jul. 1, 2019, now Pat. No. 10,695,684.

(51) Int. Cl.
*A63H 3/00* (2006.01)
*A63H 13/02* (2006.01)

(52) U.S. Cl.
CPC ..... *A63H 13/02* (2013.01); *A63H 3/00* (2013.01)

(58) Field of Classification Search
CPC ..... A63H 13/02; A63H 3/00
USPC ..... 446/278, 330, 331, 352, 353, 354, 355, 446/356, 368, 390, 490, 486
See application file for complete search history.

(56) References Cited

U.S. PATENT DOCUMENTS

| | | | | | |
|---|---|---|---|---|---|
| 559,293 | A | * | 4/1896 | Kitchen | |
| 2,035,308 | A | * | 3/1936 | Ferber | A63H 7/06 446/158 |
| 2,421,279 | A | | 5/1947 | Marty et al. | |
| 2,696,056 | A | * | 12/1954 | Howard | G09B 23/32 446/366 |
| D240,941 | S | * | 8/1976 | Juanita et al. | D21/616 |
| 4,393,728 | A | * | 7/1983 | Larson | B25J 18/06 74/469 |
| 4,986,791 | A | * | 1/1991 | Alfaro | A63H 3/14 446/361 |
| 5,317,952 | A | * | 6/1994 | Immega | B25J 9/104 74/490.04 |

(Continued)

*Primary Examiner* — Nini F Legesse
(74) *Attorney, Agent, or Firm* — Aird & McBurney LP

(57) ABSTRACT

An articulating object is provided, and may include a first body portion, a second body portion, a first cable segment and a cable drive system. The second body portion has a neutral axis and is articulatable. The first cable segment extends along the second body portion on a first side of the neutral axis. The first cable segment is of a push-pull cable type. The cable drive system is drivable to move the first cable segment in a first direction to generate a first moment on the second body portion in a first moment direction, thereby driving articulation of the second body portion in a first articulation direction, and is drivable to move the first cable segment in a second direction to generate a first moment on the second body portion in a second moment direction, thereby driving articulation of the second body portion in a second articulation direction.

14 Claims, 7 Drawing Sheets

(56) References Cited

U.S. PATENT DOCUMENTS

| | | | | |
|---|---|---|---|---|
| 5,628,667 | A * | 5/1997 | Levi | A63H 11/12 446/278 |
| 6,142,851 | A | 11/2000 | Lewinski | |
| 6,537,130 | B1 | 3/2003 | Lee | |
| 6,773,327 | B1 * | 8/2004 | Felice | A63H 13/02 446/330 |
| 7,695,341 | B1 | 4/2010 | Maddocks et al. | |
| 8,272,918 | B2 | 9/2012 | Lam | |
| D752,158 | S * | 3/2016 | McNulty | D21/616 |
| 10,695,684 | B1 * | 6/2020 | Greenley | A63H 3/00 |
| 2010/0003889 | A1 * | 1/2010 | Greenley | A63H 31/06 446/330 |
| 2012/0276807 | A1 | 11/2012 | Cabrera | |

* cited by examiner

ARTICULATING OBJECT

CROSS-REFERENCE TO RELATED APPLICATIONS

This application is a continuation of U.S. patent application Ser. No. 16/459,591 filed on Jul. 1, 2019, the contents of which are incorporated herein by reference in their entirety.

FIELD

The specification relates generally to articulating objects. In particular, the specification relates to objects that articulate using one or more cables.

BACKGROUND OF THE DISCLOSURE

It is known to construct remote control toy characters that incorporate articulating structures that are caused to articulate via cables. However, these articulating structures are in some instances complex, being composed of many parts. They can also be expensive as a result of their complexity. Furthermore, they can possess poor positional precision in the sense that it is difficult to position the articulating portion in a repeatable way to a specific position.

SUMMARY OF THE DISCLOSURE

In one aspect, there is provided an articulating object, which includes a first body portion, a second body portion extending from the first body portion, a first cable segment and a cable drive system. The second body portion has a neutral axis and is articulatable relative to the first body portion. The first cable segment extends along the second body portion on a first side of the neutral axis and is connected to the second body portion. The first cable segment is of a push-pull cable type. The cable drive system is drivable to move the first cable segment in a first direction for the first cable segment so as to generate a first moment on the second body portion in a first moment direction, thereby driving articulation of the second body portion in a first articulation direction. The cable drive system is drivable to move the first cable segment in a second direction for the first cable segment so as to generate a first moment on the second body portion in a second moment direction, thereby driving articulation of the second body portion in a second articulation direction.

In another aspect, there is provided an articulating object, which includes a first body portion, a second body portion extending from the first body portion; a first cable segment, a second cable segment and a cable drive segment. The second body portion has a neutral axis and is articulatable. The first cable segment extends along the second body portion on a first side of the neutral axis and is connected to the second body portion. The second cable segment extends along the second body portion on a second side of the neutral axis and is connected to the second body portion. The cable drive system is drivable to move the first cable segment so as to generate a moment on the second body portion in a first moment direction, thereby driving articulation of the second body portion in a first articulation direction, and that is drivable to move the second cable segment so as to generate a moment on the second body portion in a second moment direction, thereby driving articulation of the second body portion in a second articulation direction. The second body portion includes a second body portion core member that is a monolithic element that has an undulating shape so as to permit articulation of the second body portion in the first and second articulation directions. The undulating shape includes a plurality of first folds on a first side of the neutral axis, and a plurality of second folds on a second side of the neutral axis, wherein the first folds and the second folds alternate with one another. The first and second folds are living hinges which open and close during articulation of the second body portion in the first and second articulation directions.

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings in which.

Figure 1:
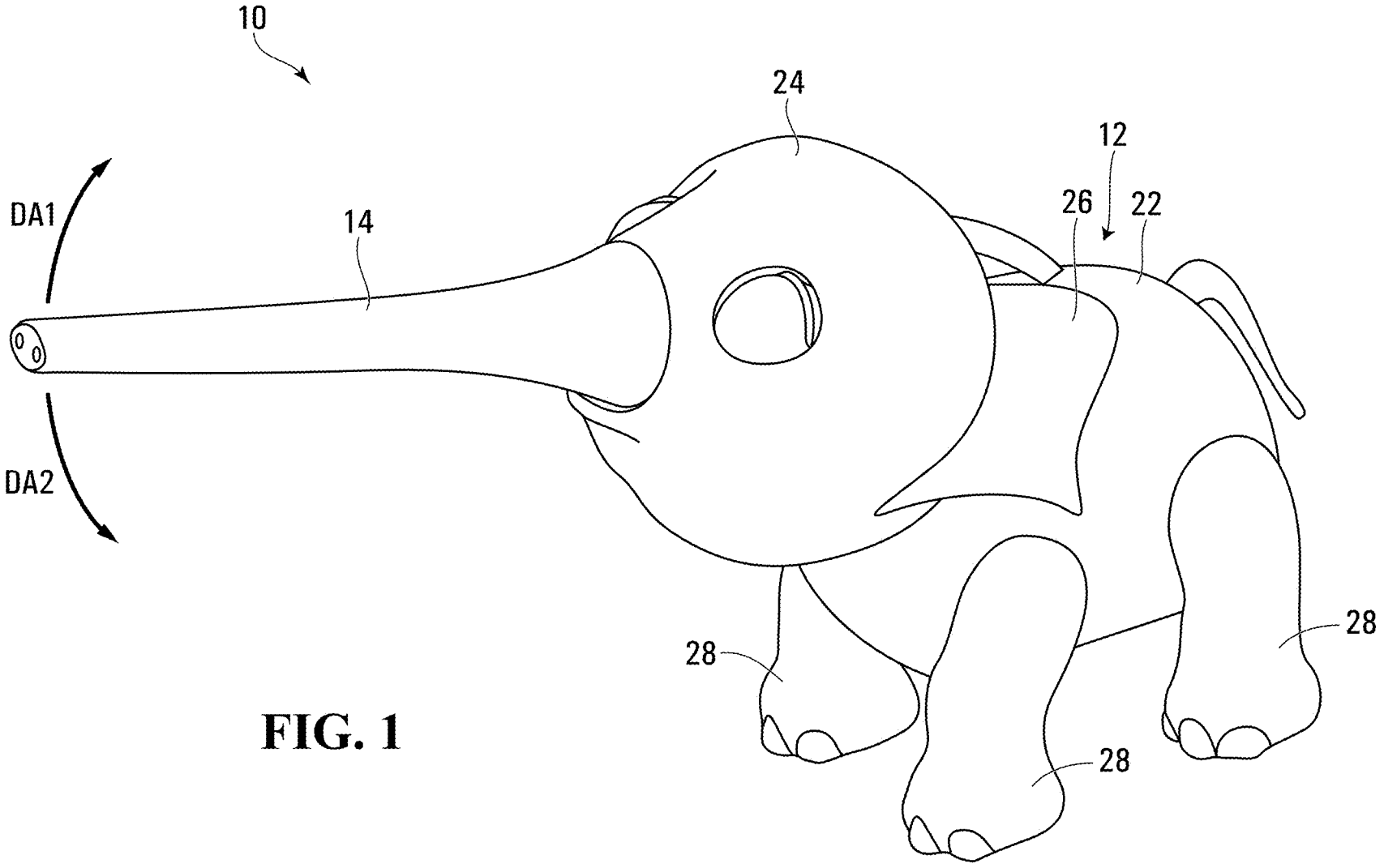
FIG. 1 shows a perspective view of an articulating object in accordance with an embodiment of the present disclosure.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Reference is made to FIG. 1, which shows an articulating object 10 in accordance with an embodiment of the present disclosure. The articulating object 10 may be in the form of a character figure, such as a fictitious, extinct, or present-day animal, a person, a robot, a vehicle, or any other type of character figure. In the figures, the articulating object 10 is in the form of an elephant. In other words, the character figure is an elephant. The articulating object 10 may alternatively be in any other suitable form such as the form of any suitable object.

Figure 2:
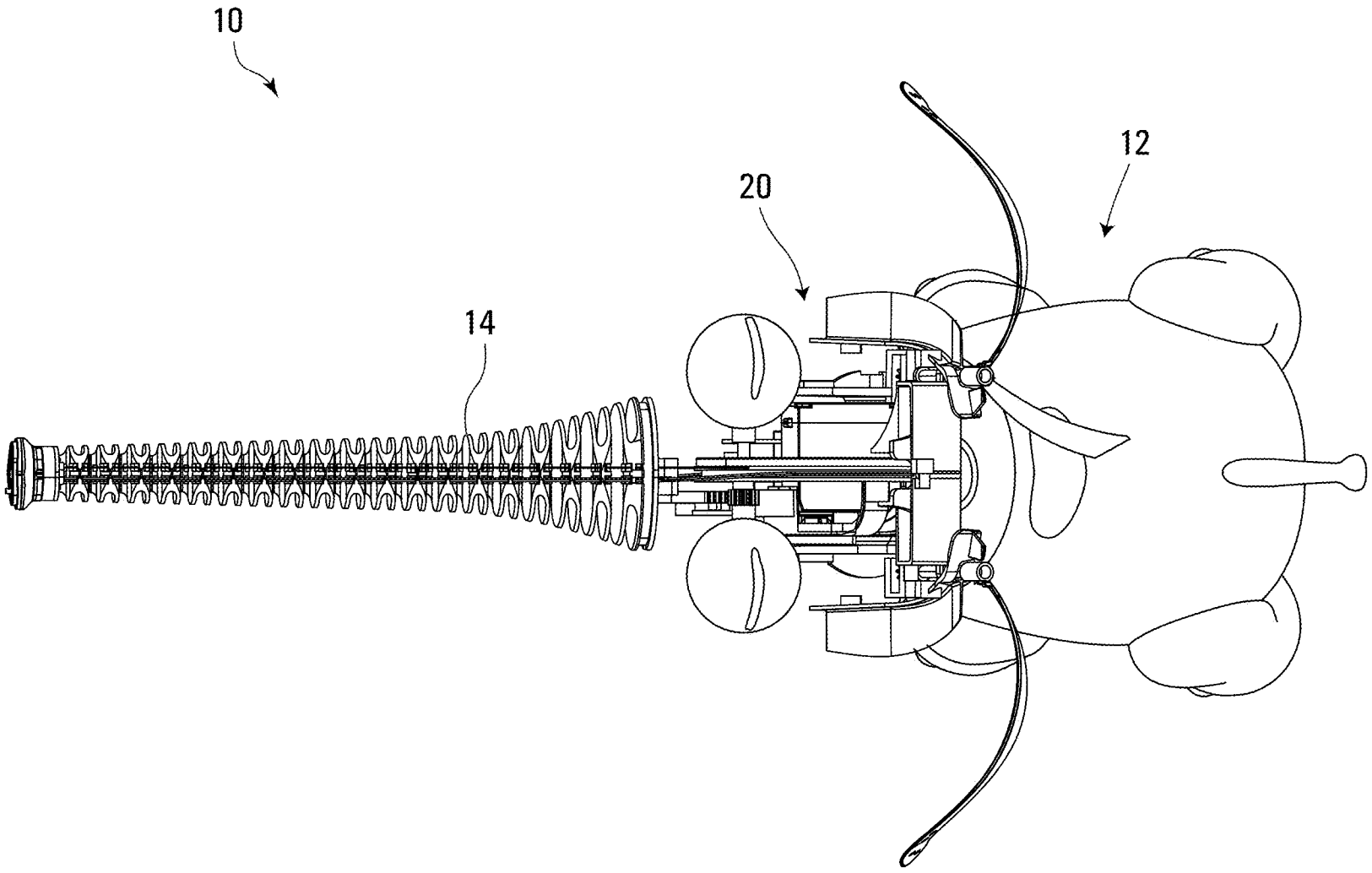
FIG. 2 is a top plan view of the articulating object shown in FIG. 1.

As more clearly shown in FIG. 2, in which certain elements of the articulating object 10 are omitted so as to reveal the elements hidden thereby, the articulating object 10 includes a first body portion 12, a second body portion 14, a first cable segment 16, a second cable segment 18 and a cable drive system 20. The first body portion 12 may include a torso 22 of the character figure. In the present example, the torso 22 is an elephant torso. In the present example, the first body portion 12 further includes a head 24 of the character figure, which may be movable relative to the torso 22. The first body portion 12 in the present example further includes ears 26 which may be movably connected to the head 24, and a plurality of legs 28 which may be movably connected to the torso 22. While in the present example, the first body portion 12 includes a plurality of elements that are movably connected together (e.g. the torso 22, the head 24, the ears 26 and the legs 28), in alternative embodiments the first body portion 12 may include one element, or a plurality of elements which are fixedly connected together.

As further shown in FIG. 2, the second body portion 14 extends from the first body portion 12 and is an appendage of the character figure, such as an elephant trunk.

The second body portion 14 has a neutral axis An and is articulatable relative to the first body portion 12 in a first articulation direction DA1 and in a second articulation direction DA2. In the present example, the first and second articulation directions DA1 and DA2 are in a common first plane, which is a sagittal plane for the elephant represented by the articulating object 10. However, it will be understood that the directions DA1 and DA2 need not be in a common plane, and if they are in a common plane, it need not be in a sagittal plane.

In the present example, the second body portion 14 is also articulatable in a horizontal plane (i.e. towards the left and right of the articulating object 10 when the articulating object is standing upright. In the present example, the second body portion 14 includes a second body portion core member 30 that has an undulating shape so as to permit articulation of the second body portion 14 in the first and second articulation directions DA1 and DA2. The undulating shape includes a plurality of first folds 32 that are on a first side of the neutral axis AN, a plurality of second folds 33 that are on the second side of the neutral axis AN. The folds 32 and 33 may be living hinges which open and close during articulation of the second body portion 14 in the first and second articulation directions DA1 and DA2. The first folds 32 and the second folds 33 alternate with one another. Thus, the first folds 32 and the second folds 33 may together be referred to as a plurality of alternating folds.

In the present example, the second body portion core member 30 may be made from any suitable material such as a flexible material, such as a suitable polymeric material, such as a suitable nylon, so as to permit the opening and closing of the folds 32 during articulation of the second body portion 14.

The second body portion core member 30 may be a monolithic element, as shown in the example embodiment in the figures.

Furthermore, the second body portion core member 30 may include a plurality of first pass-through apertures 36 at least some of the first folds 32. The first cable segment 16 passes through the plurality of first pass-through apertures 36. Additionally, the second body portion core member 30 may include a plurality of second pass-through apertures 38 at least some of the second folds 33. The second cable segment 18 passes through the plurality of second pass-through apertures 38. In the present example embodiment, the first past-through apertures 36 are present in all of the first folds 32 and the second past-through apertures 38 are present in all of the second folds 33.

Figure 5:
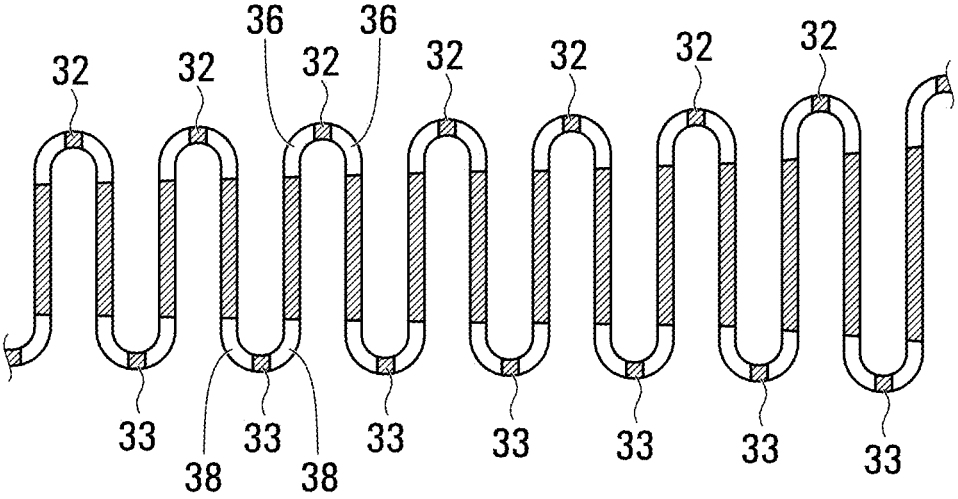
FIG. 5 is a side view of a portion of a second body portion core member, which is articulatable, from the articulating object shown in FIG. 1.
Figure 6:
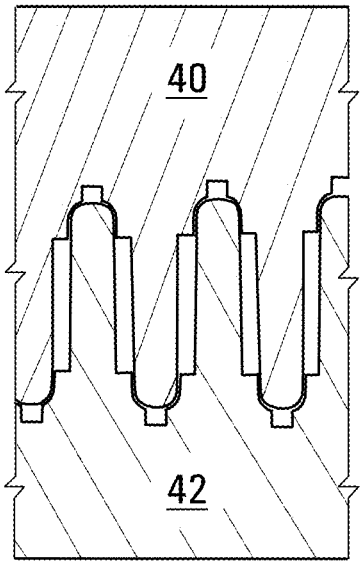
FIG. 6 is a sectional side view of a portion of a mold that can be used to form the second body portion core member shown in FIG. 5.
Figure 7:
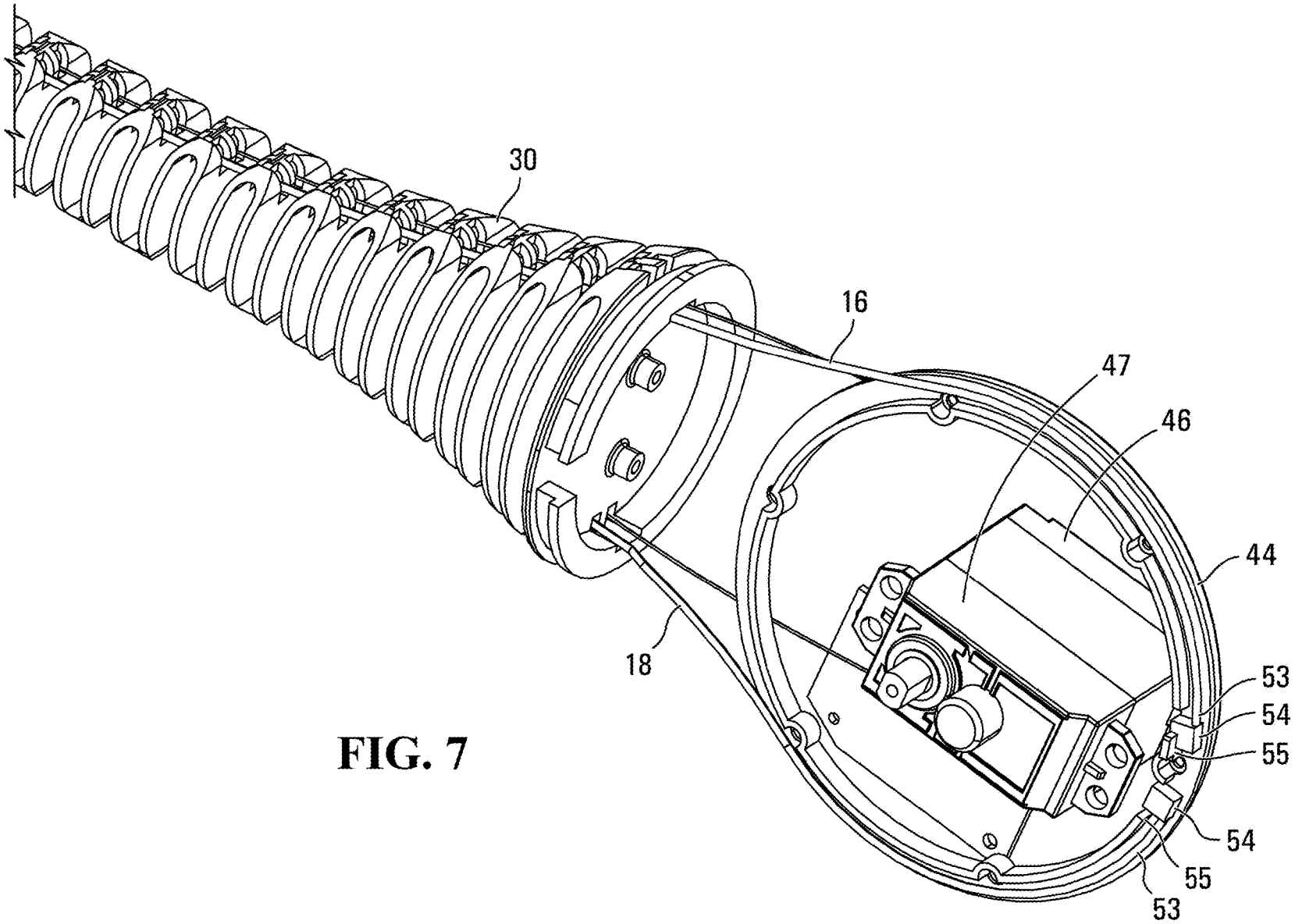
FIG. 7 is a perspective view of a portion of the second body portion core member and the cable drive system shown in FIG. 3.

As can be seen in FIG. 5 in particular, the first and second pass-through apertures 36 and 38 are configured such that they can be formed by passing projections therethrough from above or below, thereby permitting the second body portion core member 30 to be molded from a mold in which the mold cavity for the mold is formed by two mold plates without the need for slides or other elements that complicate the molding process and increase the cost of manufacture of the second body portion core member 30. FIG. 6 shows a portion of such a mold formed by a first mold plate 40 and a second mold plate 42. The mold plates 40 and 42 are shown in FIG. 6, just prior to their mating with one another to form the mold cavity so as to better show their mating surfaces. By forming the second body portion core member 30 from a monolithic member that can be molded easily, the cost to manufacture the second body portion 14 is reduced as compared to other articulating core members of the prior art, which are formed by multiple members that are assembled together.

Figure 3:
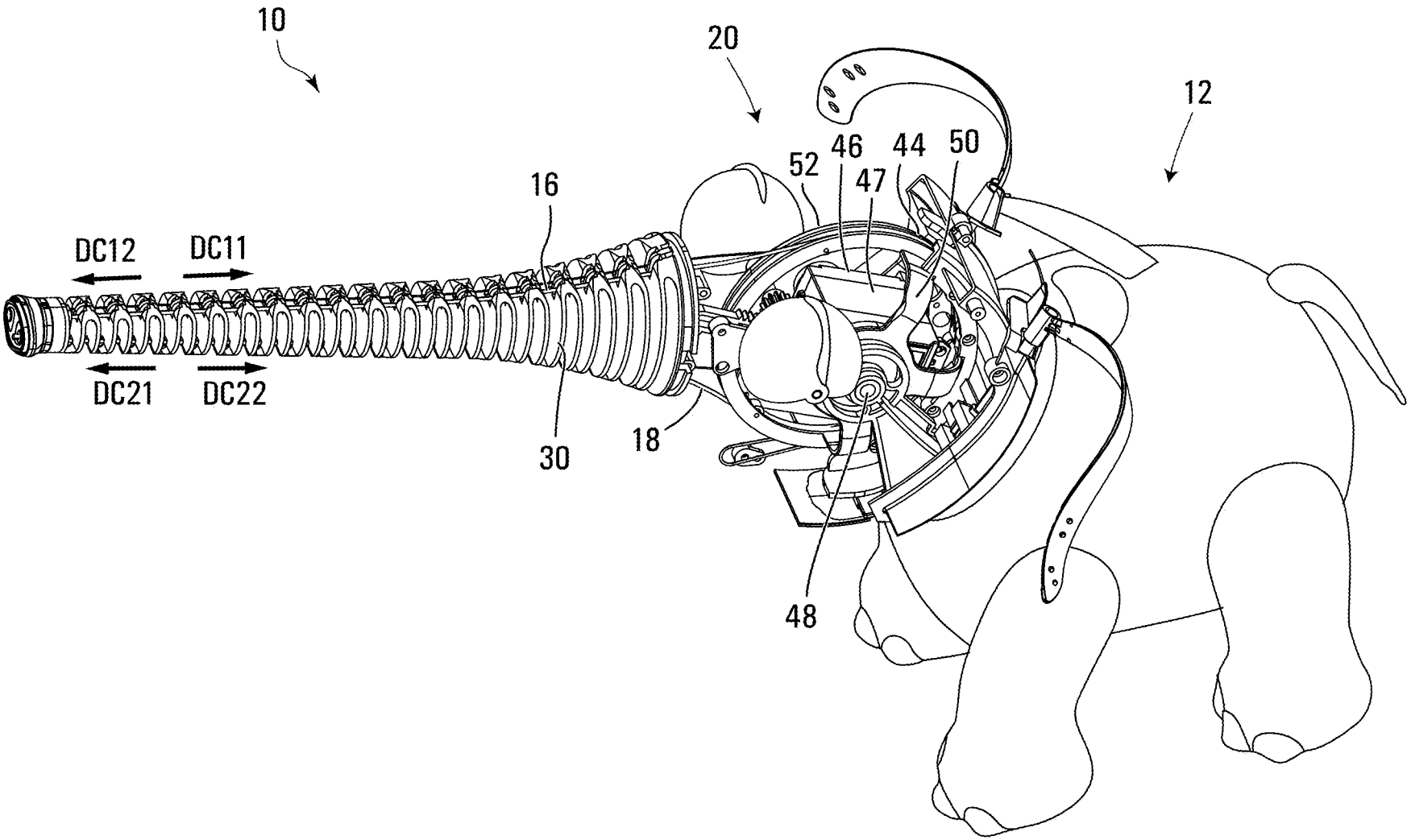
FIG. 3 is a perspective view of the articulating object shown in FIG. 1, with many parts removed to show a cable drive system that is part of the articulating object.
Figure 4:
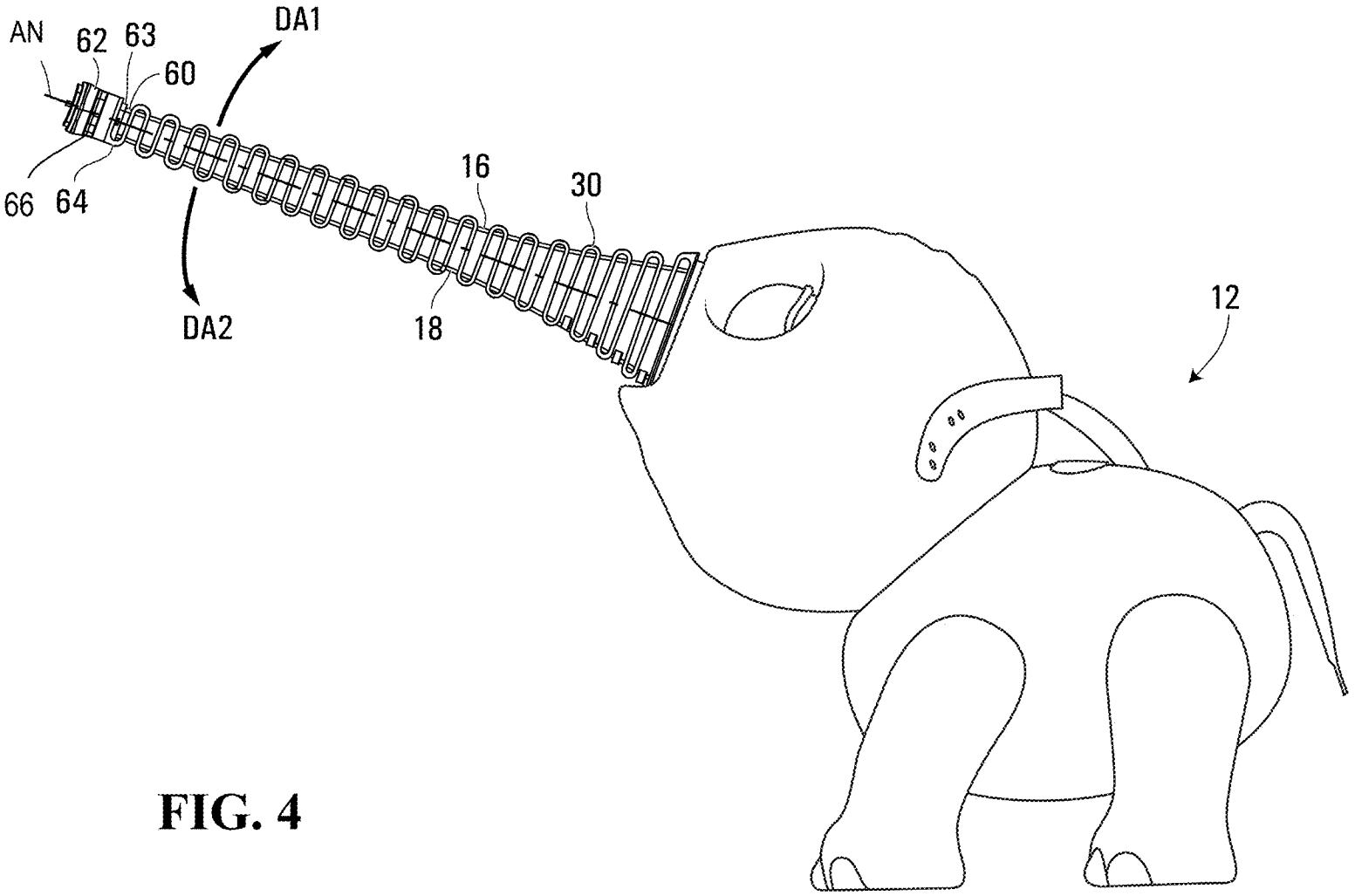
FIG. 4 is a side view of the articulating object shown in FIG. 1.

The first cable segment 16 is best shown in FIGS. 2, 3 and 6. The first cable segment 16 extends along the second body portion 14 on the first side of the neutral axis AN and is connected to the second body portion 14. Optionally, the first cable segment 16 has a distal end 60, which is connected to a distal end 62 of the second body portion 14 by any suitable means, such as by means of a ferrule 63 at the distal end 60 which is received fixedly in a ferrule receiving aperture at the distal end 62 of the second body portion 14. The first cable segment 16 may be of a push-pull cable type of cable segment. This improves the positioning precision of the second body portion 14 during articulation of the second body portion 14.

The second cable segment 18 is best shown in FIGS. 3 and 6. The second cable segment 18 extends along the second body portion 14 on the second side of the neutral axis AN and is connected to the second body portion 14. Optionally, the second cable segment 16 has a distal end 64, which is connected to a distal end 66 of the second body portion 14 in a similar way to the distal end 60 of the first cable segment 16. Like the first cable segment 16, in the present embodiment the second cable segment 18 may be a push-pull cable type of cable segment, which further improves the positioning precision of the second body portion 14 during articulation of the second body portion 14.

Figure 8:
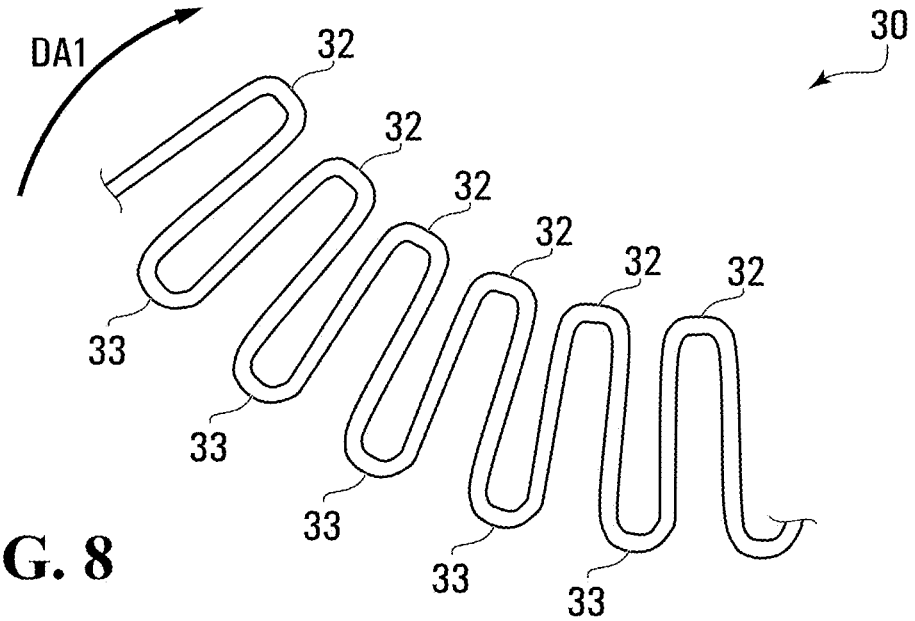
FIG. 8 shows a side view of a portion of a second body portion core member, shown articulated in a first articulation direction.
Figure 9:
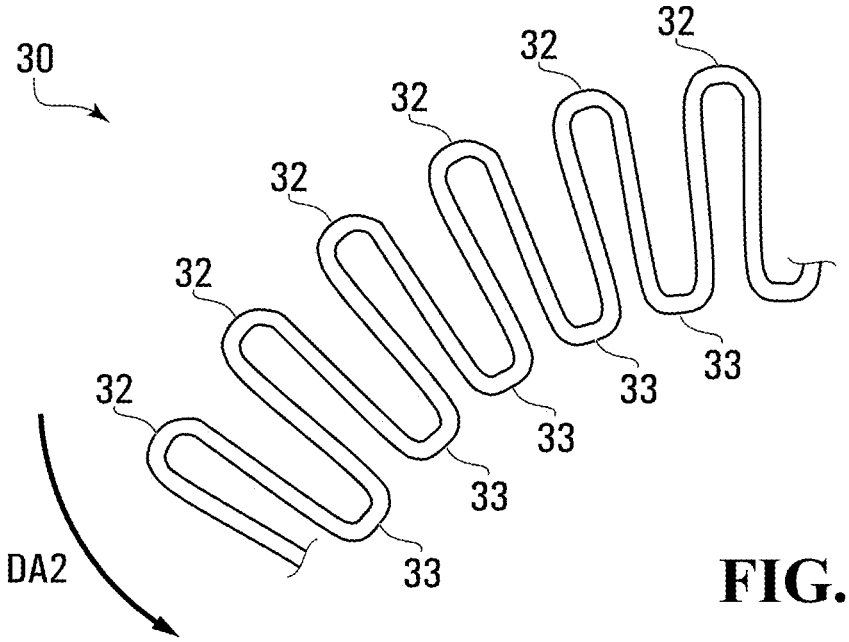
FIG. 9 shows a side view of a portion of a second body portion core member, shown articulated in a second articulation direction.

The cable drive system 20 is drivable to move the first cable segment 16 in a first direction DC11 for the first cable segment 16 (FIG. 8) so as to generate a first moment M11 on the second body portion 14 in a first moment direction (clockwise in the view shown in FIG. 8), thereby driving articulation of the second body portion 14 in the first articulation direction DA1 (which is a clockwise curling of the second body portion 14 in the view shown in FIG. 8). Movement of the first cable segment 16 in the first direction DC11 may be a pull movement. The cable drive system 20 is drivable to move the first cable segment 16 in a second direction DC12 for the first cable segment 16 (FIG. 9) so as to generate a first moment M12 on the second body portion 14 in a second moment direction (counterclockwise in the view shown in FIG. 9), thereby driving articulation of the second body portion 14 in a second articulation direction DA2 (which is a counterclockwise curling of the second body portion 14 in the view shown in FIG. 9). Movement of the first cable segment 16 in the second direction DC12 may be a push movement in embodiments in which the first cable segment 14 is a push-pull type cable segment.

In some embodiments in which the second cable segment 18 is provided, driving of the cable drive system 20 to move the first cable segment 16 in the first cable direction DC11, moves the second cable segment 18 in a first direction DC21 for the second cable segment 18 so as to generate a second moment M21 on the second body portion 14 in the first moment direction (i.e. clockwise as noted above), such that the second cable segment 18 cooperates with the first cable segment 16 to drive articulation of the second body portion 18 in the first articulation direction DA1. Movement of the second cable segment 16 in the first direction DC21 may be a push movement in embodiments in which the second cable segment 14 is a push-pull type cable segment. Furthermore, driving of the cable drive system 20 to move the first cable segment 16 in the second cable direction DC12 moves the second cable segment 18 in a second direction DC22 for the second cable segment 18 so as to generate a second moment M22 on the second body portion 18 in the second moment direction, such that the second cable segment 18 cooperates with the first cable segment 16 to drive articulation of the second body portion in the second articulation direction DA2. Movement of the second cable segment 16 in the second direction DC22 may be a pull movement in embodiments in which the first cable segment 14 is a push-pull type cable segment.

To achieve the movement of the first and second cable segments 16 and 18, the cable drive system 20 may have any suitable structure. For example, the cable drive system 20 may be made up of a cable reel 44 and an electric motor 46. The first cable segment 16 is windable onto the cable reel 44 during movement of the first cable segment 16 in the first direction DC11 for the first cable segment 16, and is unwindable from the cable reel 44 during movement of the first cable segment 16 in the second direction DC12 for the first cable segment. Similarly, the second cable segment 18 is windable onto the cable reel 44 during movement of the second cable segment 16 in the second direction DC21 for the second cable segment 18, and is unwindable from the cable reel 44 during movement of the first cable segment 16 in the first direction DC22 for the second cable segment 18.

As can be seen, in the embodiment shown, the electric motor 46 may include a gear reduction arrangement 47 (shown enclosed in a gear housing) to reduce the speed of the electric motor 46 as necessary. The electric motor 46 includes an output shaft 48, which is connected rotationally to a hub-and-spider portion 50 of the cable reel 44. Because the electric motor 46 drives rotation of the cable reel 44 the electric motor 46 may be considered to be operatively connected to the cable reel 44 to selectively move the first cable segment 16 in the first and second directions DC11 and DC12 for the first cable segment 16 and to selectively move the second cable segment 18 in the first and second directions DC21 and DC22 for the second cable segment 18. It will be understood that the electric motor 46 may be operatively connected to the cable reel 44 in any other suitable way, such as by a belt drive or by any other drive structure.

The cable reel 44 includes a peripheral groove 52 in which the first and second cable segments 16 and 18 sit.

In some embodiments, the first and second cable segments 16 and 18 may be separate from one another and may each have a proximal end 53 that connects to the cable reel 44 e.g. by means of a ferrule 54 at the proximal end 53, which fits in a ferrule receiving aperture 55 in the cable reel 44. Alternatively, the first and second cable segments 16 and 18 may be part of a single cable that is captured on the cable reel 44.

Aside from the advantage of greater positional precision by using push-pull type cable segments for the first and second cable segments 16 and 18, it is also advantageous in that it permits the articulating object 10 to operate with only the first cable segment 16, and therefore to not include a second cable segment.

It will further be noted that the second body portion core member 30 is advantageous regardless of whether the first and second cable segments 16 and 18 are push-pull type cable segments or whether they are simply pull-type cable segments, wherein the second body portion includes a second body portion core member that is a monolithic element that has an undulating shape so as to permit articulation of the second body portion in the first and second articulation directions, wherein the undulating shape includes a plurality of alternating folds which are living hinges which open and close during articulation of the second body portion in the first and second articulation directions, wherein the alternating folds are on the first side and a second side of the neutral axis.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. An articulating object, comprising:

a first body portion;

a second body portion extending from the first body portion, wherein the second body portion has a neutral axis;

a first cable segment that extends along the second body portion on a first side of the neutral axis and is connected to the second body portion, wherein the first cable segment is of a push-pull cable type; and a cable drive system that is drivable to pull the first cable segment in a first direction for the first cable segment so as to generate a first moment on the second body portion in a first moment direction, thereby driving articulation of the second body portion in a first articulation direction, and wherein the cable drive system is drivable to push the first cable segment in a second direction for the first cable segment so as to generate a first moment on the second body portion in a second moment direction that is opposite the first moment direction, thereby driving articulation of the second body portion in a second articulation direction that is opposite the first articulation direction, wherein the cable drive system includes a cable reel that is rotatable, wherein the first cable segment is woundable onto the cable reel during movement in the first direction for the first cable segment, and is unwoundable from the cable reel during movement in the second direction for the first cable segment, wherein the cable drive system includes an electric motor that is operatively connected to the cable reel to drive the cable reel to selectively move the first cable segment in the first and second directions for the first cable segment.

2. An articulating object as claimed in claim 1, further comprising a second cable segment that extends along the second body portion on a second side of the neutral axis and is connected to the second body portion, wherein the second cable segment is of the push-pull cable type, wherein driving of the cable drive system to move the first cable segment in the first direction for the first cable segment moves the second cable segment in a first direction for the second cable segment so as to generate a second moment on the second body portion in the first moment direction, such that the second cable segment cooperates with the first cable segment to drive articulation of the second body portion in the first articulation direction, and wherein driving of the cable drive system to move the first cable segment in the second direction for the first cable segment moves the second cable segment in a second direction for the second cable segment so as to generate a second moment on the second body portion in the second moment direction, such that the second cable segment cooperates with the first cable segment to drive articulation of the second body portion in the second articulation direction.

3. An articulating object as claimed in claim 2, wherein the cable drive system includes a cable reel that is rotatable, wherein, during movement of the first cable segment in the first direction for the first cable segment, the first cable segment is wound onto the cable reel and the second cable segment is unwound from the cable reel, and wherein, during movement of the first cable segment in the second direction for the first cable segment, the first cable segment is unwound from the cable reel and the second cable segment is wound onto the cable reel.

4. An articulating object as claimed in claim 3, wherein the first and second cable segments each have a proximal end that connects to the cable reel.

5. An articulating object as claimed in claim 1, wherein the second body portion includes a second body portion core member that has an undulating shape so as to permit articulation of the second body portion in the first and second articulation directions.

6. An articulating object as claimed in claim 5, wherein the undulating shape includes a plurality of first folds on a first side of the neutral axis, and a plurality of second folds on a second side of the neutral axis, wherein the first folds and the second folds alternate with one another, and wherein the first and second folds connect to one another, wherein the first and second folds are living hinges which open and close during articulation of the second body portion in the first and second articulation directions.

7. An articulating object as claimed in claim 6, wherein the second body portion core member is a monolithic element.

8. An articulating object as claimed in claim 7, wherein the second body portion core member includes a plurality of first pass-through apertures at at least some of the first folds, wherein the first cable segment passes through the plurality of first pass-through apertures.

9. An articulating object as claimed in claim 1, wherein the first body portion includes a torso of a character figure and the second body portion is an appendage of the character figure.

10. An articulating object as claimed in claim 9, wherein the character figure is an elephant, and the appendage is an elephant trunk.

11. An articulating object, comprising:

a first body portion;

a second body portion extending from the first body portion, wherein the second body portion has a neutral axis;

a first cable segment that extends along the second body portion on a first side of the neutral axis and is connected to the second body portion, wherein the first cable segment is of a push-pull cable type; and a cable drive system that is drivable to pull the first cable segment in a first direction for the first cable segment so as to generate a first moment on the second body portion in a first moment direction, thereby driving articulation of the second body portion in a first articulation direction, and wherein the cable drive system is drivable to push the first cable segment in a second direction for the first cable segment so as to generate a first moment on the second body portion in a second moment direction that is opposite the first moment direction, thereby driving articulation of the second body portion in a second articulation direction that is opposite the first articulation direction, further comprising a second cable segment that extends along the second body portion on a second side of the neutral axis and is connected to the second body portion, wherein the second cable segment is of the push-pull cable type, wherein driving of the cable drive system to move the first cable segment in the first direction for the first cable segment moves the second cable segment in a first direction for the second cable segment so as to generate a second moment on the second body portion in the first moment direction, such that the second cable segment cooperates with the first cable segment to drive articulation of the second body portion in the first articulation direction, and wherein driving of the cable drive system to move the first cable segment in the second direction for the first cable segment moves the second cable segment in a second direction for the second cable segment so as to generate a second moment on the second body portion in the second moment direction, such that the second cable segment cooperates with the first cable segment to drive articulation of the second body portion in the second articulation direction.

12. An articulating object as claimed in claim 11, wherein the cable drive system includes a cable reel that is rotatable, wherein, during movement of the first cable segment in the first direction for the first cable segment, the first cable segment is wound onto the cable reel and the second cable segment is unwound from the cable reel, and wherein, during movement of the first cable segment in the second direction for the first cable segment, the first cable segment is unwound from the cable reel and the second cable segment is wound onto the cable reel.

13. An articulating object as claimed in claim 12, wherein the first and second cable segments each have a proximal end that connects to the cable reel.

14. An articulating object, comprising:

a first body portion;

a second body portion extending from the first body portion, wherein the second body portion has a neutral axis;

a first cable segment that extends along the second body portion on a first side of the neutral axis and is connected to the second body portion, wherein the first cable segment is of a push-pull cable type; and a cable drive system that is drivable to pull the first cable segment in a first direction for the first cable segment so as to generate a first moment on the second body portion in a first moment direction, thereby driving articulation of the second body portion in a first articulation direction, and wherein the cable drive system is drivable to push the first cable segment in a second direction for the first cable segment so as to generate a first moment on the second body portion in a second moment direction that is opposite the first moment direction, thereby driving articulation of the second body portion in a second articulation direction that is opposite the first articulation direction, wherein the second body portion includes a second body portion core member that has an undulating shape so as to permit articulation of the second body portion in the first and second articulation directions.

* * * * *